US006657847B1

(12) United States Patent
Wright et al.

(10) Patent No.: US 6,657,847 B1
(45) Date of Patent: Dec. 2, 2003

(54) METHOD OF USING INDUCTANCE FOR DETERMINING THE POSITION OF AN ARMATURE IN AN ELECTROMAGNETIC SOLENOID

(75) Inventors: Danny Orlen Wright, Cobbs Creek, VA (US); Perry Robert Czimmek, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 504 days.

(21) Appl. No.: 09/606,536

(22) Filed: Jun. 30, 2000

Related U.S. Application Data

(60) Provisional application No. 60/143,619, filed on Jul. 13, 1999.

(51) Int. Cl.[7] ..... H01H 47/00

(52) U.S. Cl. ..... 361/160; 361/152; 361/154

(58) Field of Search ..... 361/152, 160, 361/154

(56) References Cited

U.S. PATENT DOCUMENTS

| | | | | |
|---|---|---|---|---|
| 4,544,986 A | | 10/1985 | Buchl | 361/152 |
| 4,608,620 A | | 8/1986 | Hines | 361/154 |
| 4,665,348 A | | 5/1987 | Stupak, Jr. | 318/135 |
| 5,339,063 A | | 8/1994 | Pham | 335/260 |
| 5,481,187 A | | 1/1996 | Marcott et al. | 324/207.16 |
| 5,490,031 A | | 2/1996 | Braun et al. | 361/93 |
| 5,742,467 A | | 4/1998 | Schmitz | 361/154 |
| 5,868,108 A | | 2/1999 | Schmitz et al. | 123/90.11 |
| 5,905,625 A | | 5/1999 | Schebitz | 361/154 |
| 5,920,004 A | | 7/1999 | Gottshall et al. | 73/1.36 |
| 5,991,143 A | | 11/1999 | Wright et al. | 361/187 |
| 6,111,741 A | | 8/2000 | Schmitz et al. | 361/143 |
| 6,176,207 B1 | | 1/2001 | Wright et al. | 123/90.11 |
| 6,285,151 B1 | * | 9/2001 | Wright et al. | 318/560 |

FOREIGN PATENT DOCUMENTS

| | | |
|---|---|---|
| DE | 37 30 523 | 3/1989 |
| DE | 195 35 211 | 3/1997 |
| DE | 195 35 211 A1 | 3/1997 |
| DE | 195 44 207 | 6/1997 |
| DE | 197 23 563 | 12/1998 |
| EP | 0 924 589 | 6/1999 |
| EP | 0 927 817 | 7/1999 |
| WO | WO 98/38656 | 9/1998 |

* cited by examiner

*Primary Examiner*—Stephen W. Jackson

(57) ABSTRACT

An improved method for controlling the landing velocity of an armature in an electromechanical actuator, such as a fuel injector, fuel pressure regulator, or engine valve actuator is provided. The position and velocity of an armature during a stroke is dynamically estimated by calculating the inductance and rate of change of inductance of the actuator coil in real-time as the armature moves through its stroke, compensating for non-linear permeability and magnetization effects due to changing gap, temperature, magnetic material properties or magnetic architecture, normalizing the calculated inductance value at the end of a stroke (zero gap), and mapping the value of normalized inductance to correspond to an armature position by an algebraic transformation. Inductance may be used directly as a position variable without mapping it to units of position. Rate of change of inductance may be used as a rate variable without mapping it to units of velocity.

37 Claims, 15 Drawing Sheets

$$V_{(t)a\text{-}b} = N\, d\Phi/dt + I_{(t)} R$$

METHOD OF USING INDUCTANCE FOR DETERMINING THE POSITION OF AN ARMATURE IN AN ELECTROMAGNETIC SOLENOID

This application claims the benefit of U.S. Provisional Application No. 60/143,619, filed Jul. 13, 1999, which is hereby incorporated by reference in its entirety.

BACKGROUND OF THE INVENTION

This invention relates to a high-speed, high-force electromagnetic actuator, and particularly to an electromagnetic actuator and method for opening and closing a valve of an internal combustion engine, driving a high pressure fuel injector, or operating a high pressure fuel regulator. More particularly, this disclosure relates to an apparatus and method of dynamically measuring the inductance and rate of change of inductance of a, electromechanical actuator as the armature moves from one pole piece toward another and inferring armature position and velocity from the measured inductance. Still more particularly, this invention relates to an electronic apparatus and method of using inductance and rate of change of inductance for dynamically controlling the landing velocity of an armature in a fuel injector or an electromagnetic actuator for opening and closing a valve of an internal combustion engine.

Electromagnetic actuators, such as fuel injectors, actuators for opening and closing a valve in an internal combustion engine (hereinafter "Electronic Valve Timing" or "EVT" actuators), and fuel pressure regulators, typically include a solenoid for generating magnetic force. A solenoid is an insulated conducting wire wound to form a tight helical coil. When current passes through the wire, a magnetic field is generated within the coil in a direction parallel to the axis of the coil. The resulting magnetic field exerts a force on a moveable ferromagnetic armature located within the coil, thereby causing the armature to move from a first position to a second position in opposition to a force generated by a return spring. The force exerted on the armature is proportional to the strength of the magnetic field and the strength of the magnetic field depends on the number of turns of the coil and the amount of current passing through the coil.

While it will be appreciated by those skilled in the art of electromechanical actuators that the techniques described in the present disclosure may be applied to any electromechanical actuator, including, for example, fuel injectors or fuel pressure regulators, for purposes of clarity the present invention will be described primarily in the context of an EVT actuator for opening and closing a valve of an internal combustion engine.

An EVT actuator generally includes an electromagnet for producing an electromagnetic force on an armature. The armature is typically neutrally-biased by opposing first and second return springs and coaxially coupled with a cylinder valve stem of an engine. In operation, the armature is held by the electromagnet in a first operating position against a stator core of the actuator. By selectively de-energizing the electromagnet, the armature may begin movement towards a second operating position under the influence of a force exerted by the first return spring. Power to a coil of the actuator may then be applied to move the armature across a gap and begin compressing the second return spring.

As can be appreciated by those skilled in the art, it is desirable to closely balance the spring force on the armature with the magnetic forces acting on the armature in the region near the stator core so as to achieve a near-zero velocity "soft landing" of the armature against the stator core. In order to obtain a soft-landing of the armature against the stator core, power to the coil may be modulated to reduce the armature velocity as the armature approaches the stator core in the second position. The coil may then be re-energized, just before landing the armature, to draw and hold the armature against the stator core. In practice, a soft landing may be difficult to achieve because the system is continually perturbed by transient variations in friction, supply voltage, exhaust back pressure, armature center point, valve lash, engine vibration, oil viscosity, tolerance stack up, temperature, etc.

Soft landing techniques are becoming especially important with modern high-pressure fuel injectors and direct injection fuel injectors that employ strong return springs. Soft landing the injector armature reduces injector noise and internal wear. In addition to noise reduction, soft landing has the benefit of reducing power consumption in the actuator because it enables controlled metering of the coil current so as to only place the required amount of magnetic energy in the system necessary to actuate the armature. Soft landing techniques may also be applied to control the landing velocity of an armature in a high pressure fuel regulator.

In the case of EVT actuators, experimental results for particular engines and actuator arrangements indicate that to achieve quiet EVT actuator operation and prevent excessive impact wear on the armature and stator core, the landing velocity of the armature should be less than 0.04 meters per second at 600 engine rpm and less than 0.4 meters per second 6,000 engine rpm. In order to achieve these results under non-ideal conditions (e.g., the harsh environment of an internal-combustion engine), it is necessary to dynamically monitor and adjust the magnetic flux generated within the magnetic circuit to compensate for variations in operating voltage, friction within the actuator, engine back-pressure and vibration, during every stroke of the armature. External sensors, such as Hall sensors, have been used to measure flux in electromagnetic actuators. However, sensors have proven to be too costly and cumbersome for practical applications.

PID (proportional, integral, derivative) control methods have been proposed to control the landing velocity of an armature in an electromagnetic actuator. An example of using PID methods to control the landing velocity of an armature in an electromagnetic actuator is disclosed in U.S. patent application Ser. No. 09/434,513, filed Nov. 5, 1999 and entitled "Method of Compensation for Flux Control of an Electromechanical Actuator," the contents of which is hereby incorporated in its entirety into the present specification by reference. Generally, PID control systems can only perfectly compensate a linear system with state variables that are not interactive. Electromagnetic actuator systems are, however, highly nonlinear due at least in part to changing magnetic permeability as the armature moves within the actuator. In addition, the state variables of an actuator (i.e., flux, position, and velocity) are highly interactive. In order to apply PID methods to control the landing velocity of an armature in an electromagnetic actuator, simplifying linear approximations are necessary, e.g., the system must be presumed linear over small armature displacements and the state variables must be presumed to be independent. Accordingly, there is a need for a true multivariate control system capable of controlling all state variables simultaneously and compensating a nonlinear feedback control system.

The present invention overcomes the two classical limitations of pure PID control described above by providing a sensorless position estimator that enables automatic calibration of the system. Sensorless position estimation accounts for much of the non-linearity of the system. Knowing armature position throughout the armature stroke makes it possible to self-calibrate the control system. This is because once armature position is known, together with another state variable such as velocity, it is possible to employ known non-linear multivariate feedback control algorithms to control the system.

The prior art lacks a practical and cost effective method of dynamically measuring armature position during the armature stroke. While lasers have been used in laboratory settings to measure armature position, it is not practical or cost effective to put a laser on actuators manufactured for large-scale production. Other more cost-effective methods of position sensing have not proven to be accurate and durable enough. For example, in automotive applications, position sensors must be able to withstand the temperature and vibration extremes of being mounted on an engine. Sensor-based techniques also present the problem of cabling the signal through a potentially electrically noisy environment. Accordingly, there is a need to estimate armature position in a sensorless manner.

Thus, a need exists for a sensorless self-calibrating control system and method for an electromagnetic actuator capable of dynamically compensating for non-ideal disturbances that exist in and near internal combustion engines. Further, a need exists for a high-speed sensorless control system and method for an electromagnetic actuator capable of detecting and compensating for the above-described non-ideal conditions during each stroke cycle of the armature.

SUMMARY OF THE INVENTION

A sensorless method of controlling the landing velocity of an armature in an electromagnetic actuator is provided. The method disclosed dynamically measures actuator inductance and rate of change of inductance as the armature moves within the coil. The B-H magnetization characteristics of the actuator during an armature stroke are determined during actuator operation and the measured inductance and rate of change of inductance are thereby compensated for non-linear permeability and magnetization effects. The measured inductance may be normalized at zero gap. In a preferred embodiment, the normalization at zero gap is to unity (1.0). From inductance, an estimation of position is made; from rate of change of inductance, armature velocity information is inferred. The armature position and rate information are provided to a control system for modulating a current delivered to the actuator, thereby controlling the armature landing velocity.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

The present invention will be described primarily in relation to an EVT actuator. However, as will be appreciated by those skilled in the art, the present invention is not so limited and may be applied to any type of electromechanical actuator including, for example, fuel injectors and fuel pressure regulators.

Figure 1A:
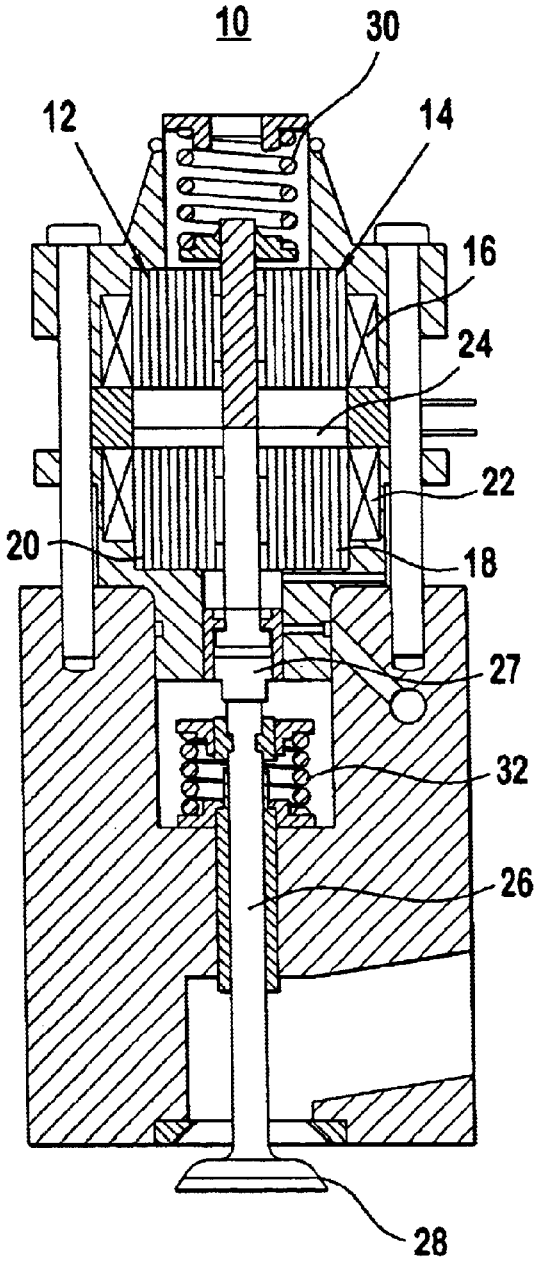
FIG. 1*a* illustrates a sectional view of an electronic valve timing electromagnetic actuator provided in accordance with the principles of the present invention, shown in a valve open position.
Figure 1B:
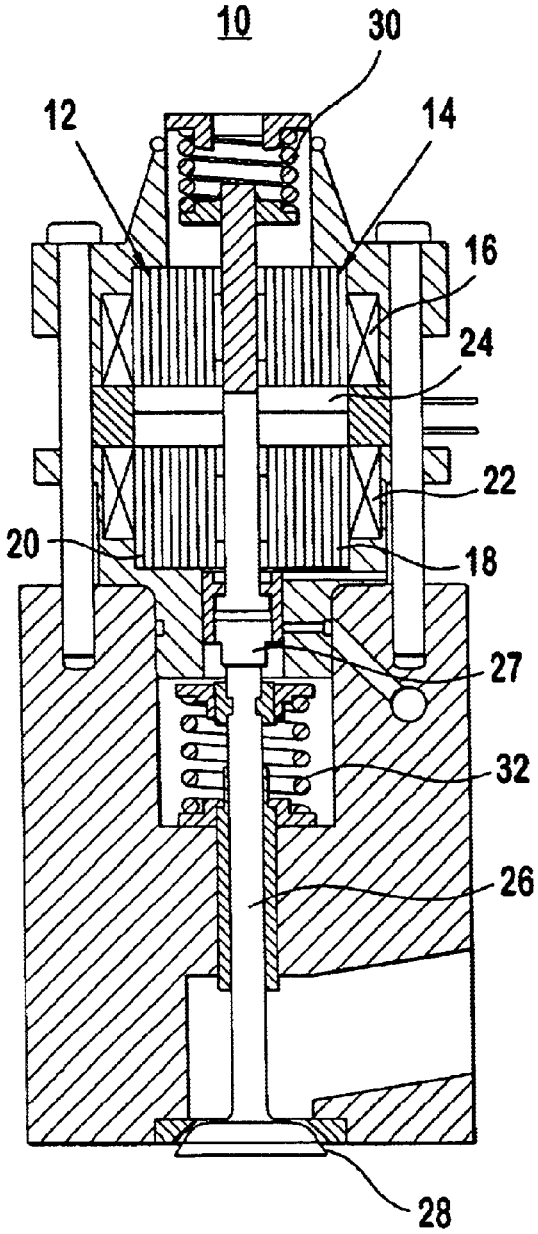
FIG. 1*b* illustrates a sectional view of an electronic valve timing electromagnetic actuator provided in accordance with the principles of the present invention, shown in a valve closed position.

In accordance with a preferred EVT embodiment, FIGS. 1*a* and 1*b* illustrate an electromagnetic actuator 10 for opening and closing a valve in an internal combustion engine. The electromagnetic actuator 10 includes a first electromagnet 12 that includes a stator core 14 and a solenoid coil 16 associated with the stator core 14. A second electromagnet 18 is disposed in opposing relation to the first electromagnet 12. The second electromagnet includes a stator core 20 and a solenoid coil 22 associated with the stator core 20. The electromagnetic actuator 10 includes an armature 24 that is attached to a stem 26 of a cylinder valve 28 through a hydraulic valve adjuster 27. The armature 24 is disposed between the electromagnets 12 and 18 so as to be acted upon by the electromagnetic force created by the electromagnets. In a de-energized state of the electromagnets 12 and 18, the armature 24 is maintained in a neutrally-biased rest position between the two electromagnets 12 and 18 by opposing return springs 30 and 32. In a valve closed position (FIG. 1*b*), the armature 24 engages the stator core 14 of the first electromagnet 12.

To initiate motion of the armature 24 and thus the valve 28 from the closed position into an open position (FIGS. 1*a* & 1*b*), a holding current through solenoid coil 16 of the first electromagnet 12 is removed. As a result, a holding force of the electromagnet 12 falls below the spring force of the return spring 30 and thus the armature 24 begins moving under the force exerted by return spring 30. It is necessary to build enough magnetic flux in the coil 22 so there will be sufficient magnetic force to make the armature 24 move from one stator 14 to another 18 while overcoming the opposing neutrally-biased return springs. To catch the armature 24 in the open position, a catch current is applied to the electromagnet 18. Once the armature has landed at the stator core 20, the catch current is changed to a hold current which is sufficient to hold the armature at the stator core 20 for a predetermined period of time. It is desirable to dynamically control the catch current to achieve a near-zero velocity "soft" landing of the armature against the stator core.

An example of using rate of change of flux as a feedback variable is taught in U.S. patent application Ser. No. 09/025,986, filed Feb. 19, 1998 and entitled "Electronically Controlling the Landing of an Armature in an Electromagnetic Actuator", the contents of which is hereby incorporated in its entirety into the present specification by reference.

An example of feedback control based on a rate of change of flux without the need for a flux sensor is disclosed in U.S. patent application Ser. No. 09/122,042, filed Jul. 24, 1998 and entitled "A Method for Controlling Velocity of an Armature of an Electromagnetic Actuator," the contents of which is hereby incorporated in its entirety into the present specification by reference.

Figure 2:
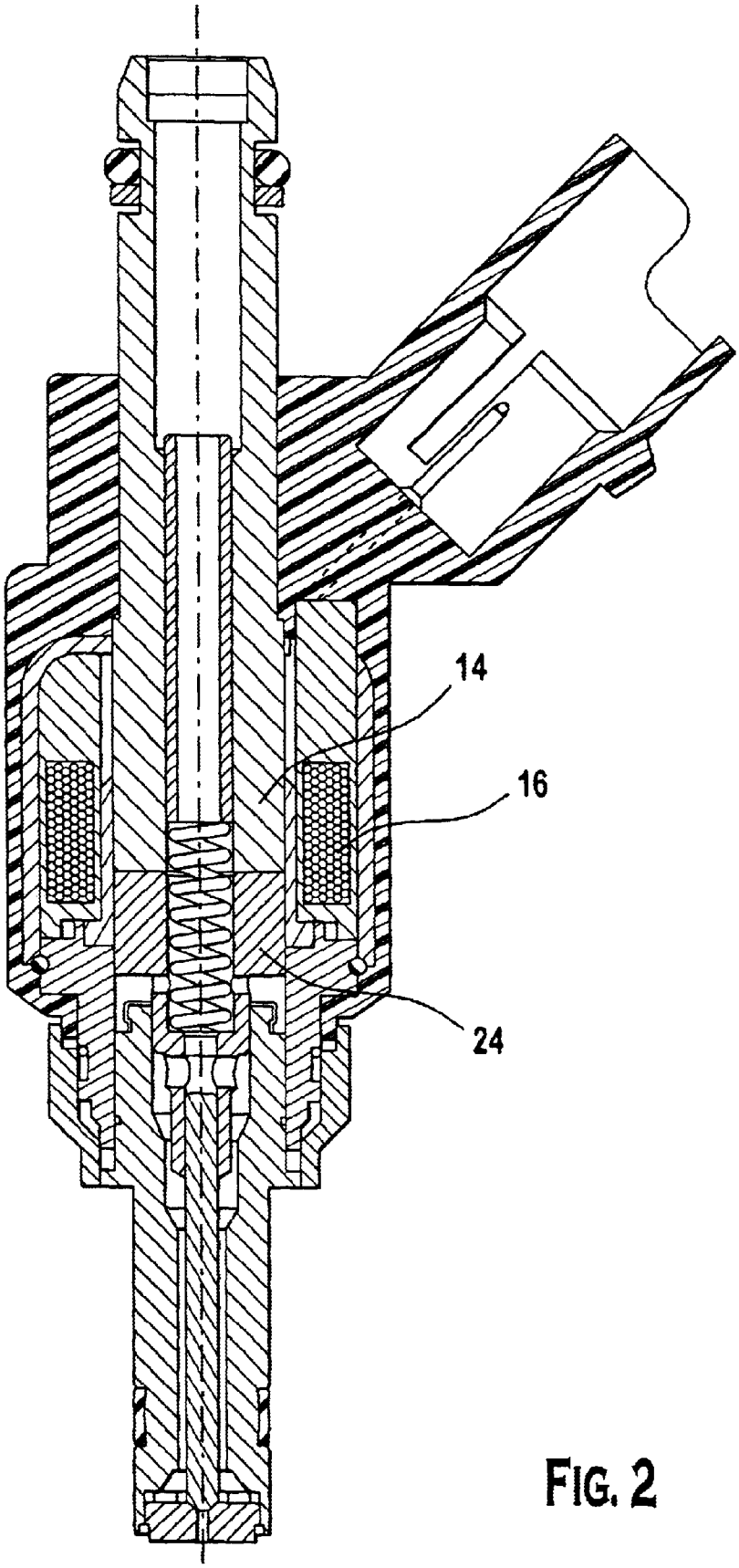
FIG. 2 illustrates a sectional view of a direct injection fuel injector provided in accordance with the principles of the present invention.
Figure 3A:
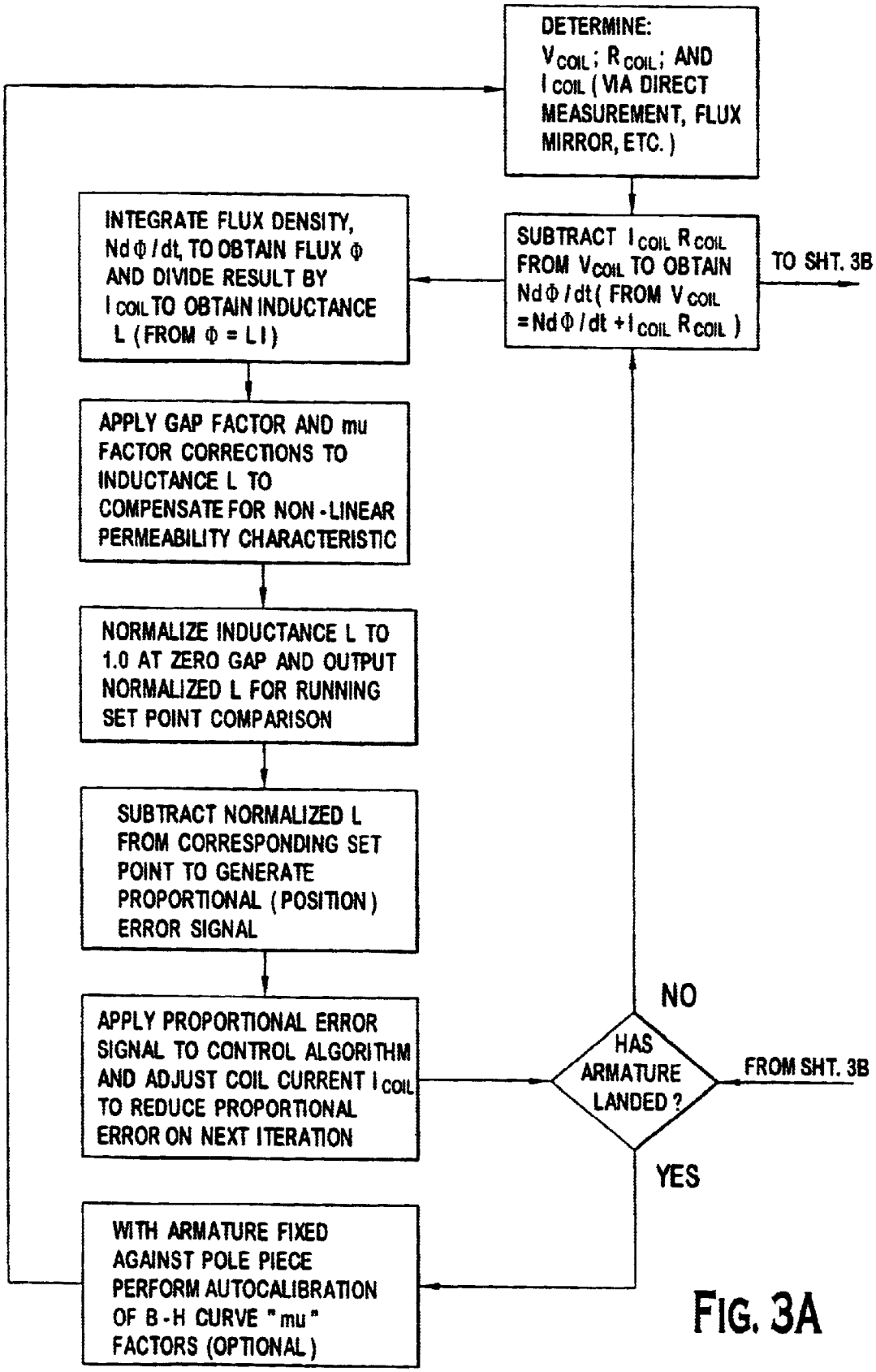
FIG. 3 is a system block diagram in accordance with a preferred embodiment of the present invention.
Figure 3B:
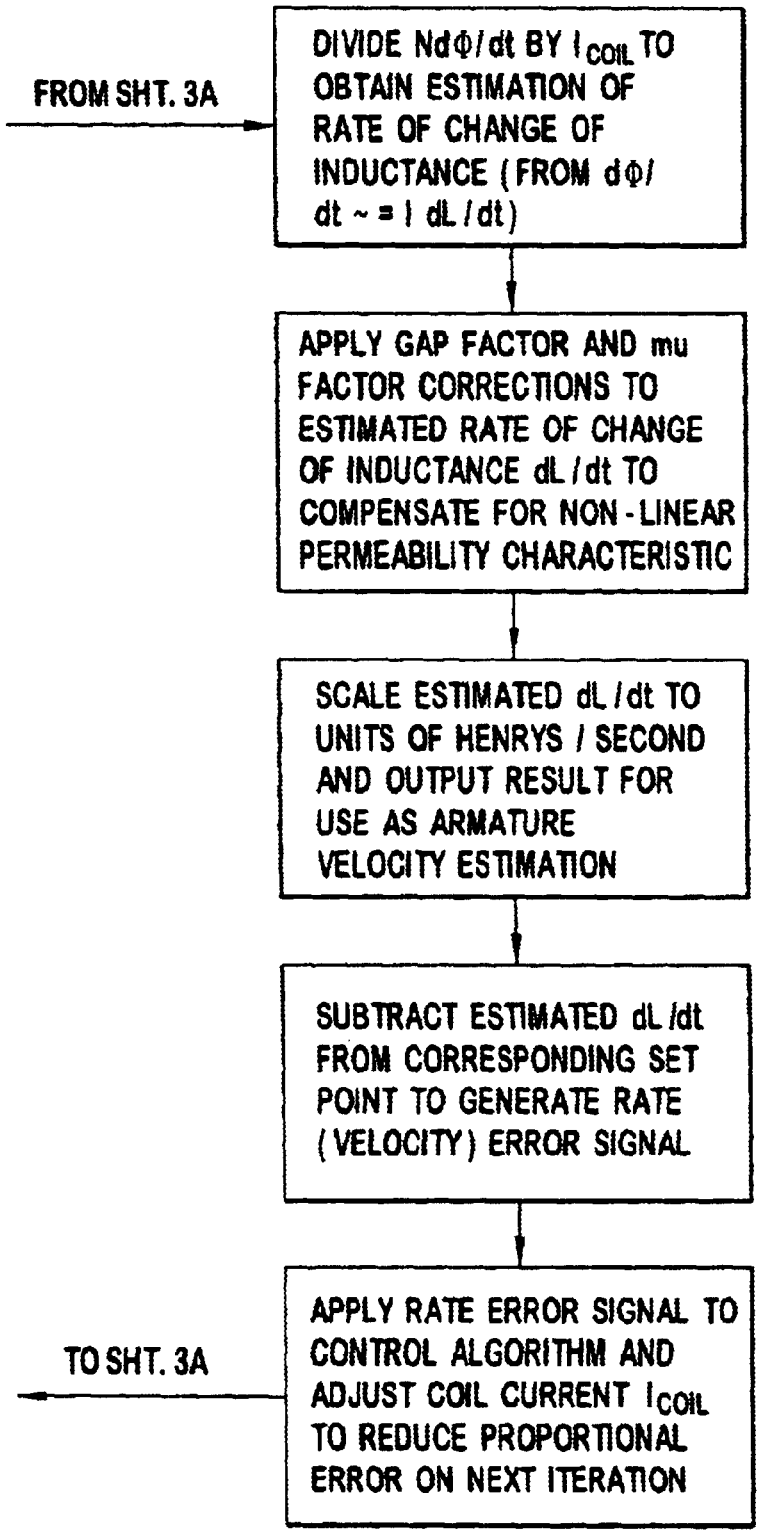

According to a presently preferred embodiment, an improved apparatus and method for controlling the landing velocity of an armature in an electromechanical solenoid, such as an EVT actuator or a fuel injector will now be described. Referring to FIGS. 1–3, the position of the armature 24 during a stroke may be dynamically estimated by calculating the inductance of the actuator solenoid in real-time as the armature 24 moves through its stroke; compensating for non-linear permeability and magnetization effects due to changing gap; normalizing the calculated inductance value to always equal unity (1.0) at the end of a stroke (zero gap); and mapping the value of normalized inductance to correspond to an armature position by an algebraic transformation. In a preferred embodiment, the inductance may be used directly as a position variable without mapping it to units of position, thus simplifying the implementation.

In similar fashion, the velocity of the armature 24 during a stroke may be dynamically estimated by calculating the rate of change of inductance of the actuator solenoid in real-time as the armature 24 moves through its stroke; compensating for non-linear permeability and magnetization effects due to changing gap; and mapping the value of rate of change of inductance to correspond to armature velocity by an algebraic transformation. In a preferred embodiment, the rate of change of inductance may be used directly as a rate variable without mapping it to units of velocity, thus simplifying the implementation.

The control loop logic that modulates the coil current, and ultimately controls the armature velocity, requires as inputs armature position, armature velocity and magnetic flux density. Accordingly, in a preferred embodiment, armature position may estimated as being proportional to a normalized value of inductance and armature velocity may be estimated as being proportional to the rate of change of inductance.

Dynamic Calculation of Inductance

Figure 4:
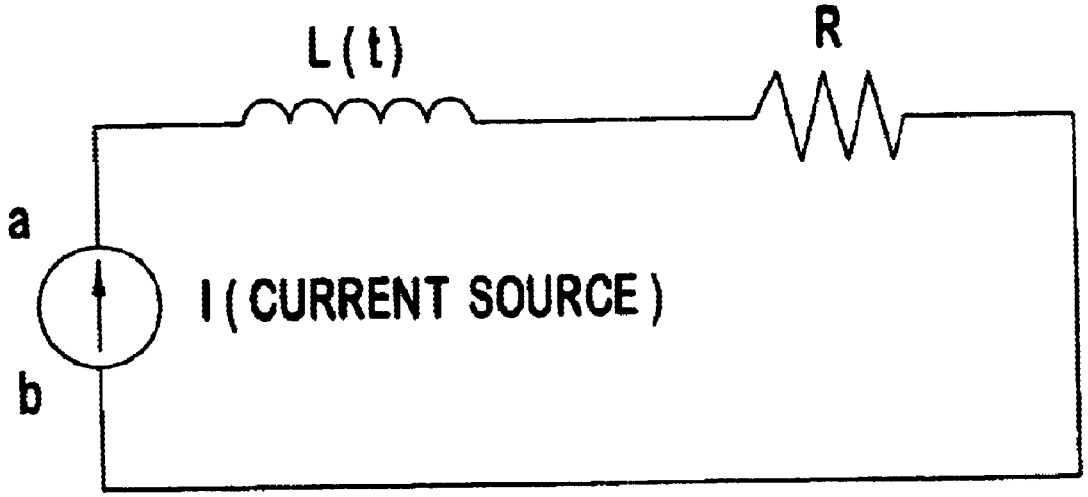
FIG. 4 illustrates the relationship between coil voltage and magnetic flux density in accordance with a preferred embodiment of the present invention.

Referring to FIG. 4, application of Kirchoff's voltage law around the loop yields the following relationship:

$V(t)_{a\text{-}b}=Nd\Phi/dt+I(t)R_{coil}$, (where N is the number of turns of the coil, $d\Phi/dt$ is the rate of change of magnetic flux, I is coil current, and $R_{coil}$ is not constant). Equation 1:

According to a presently preferred embodiment, a complete processing of the above equation is dynamically performed in iterative fashion during actuator operation. The simplifying approximations of linearity, independence of state variables (position, velocity, and flux density) and the negligible effect of the IR term, that were necessary to enable the prior art PID-type control, are not necessary in a presently preferred approach. In a presently preferred approach, all terms of Equation 1 are included in each iterative calculation.

In a presently preferred embodiment, compensation may be made for changes in coil resistance due to temperature variations. For example, real time resistance measurements may be obtained at the end of each armature stroke cycle by measuring the coil voltage necessary to maintain a steady-state current through the coil and applying Ohm's law to calculate resistance. This method of dynamically measuring coil resistance is particularly convenient because when a steady-state current is applied at the end of an armature stroke, $d\Phi/dt$ is zero and the voltage drop across the coil is IR. With V and I known, R may be readily computed. The updated value of R may then be used during the next iterative calculation of Equation 1.

The basic relationships between magnetic flux, $\Phi$, rate of change of magnetic flux, $d\Phi/dt$, and inductance, L, are as follows:

$\Phi=fd\Phi/dt$, (where $\Phi$ is magnetic flux); and Equation 2:

$L=\Phi$ (where L is the inductance of the actuator and I is coil current). Equation 3:

The resistance of the coil may be dynamically measured during the operation of the electromagnetic actuator as follows. The coil voltage may be determined either by direct measurement or from the flux mirror circuit method disclosed in U.S. Pat. No. 5,991,143, entitled "Method for Controlling Velocity of an Armature of an Electromagnetic Actuator," which is hereby incorporated into the present specification by reference in its entirety. When a known steady state current is applied, the resistance of the coil may be determined by applying Ohm's law: $R_{coil}=V_{coil}/I_{steadystate}$. By this method, the resistance of the coil may be dynamically measured during each armature stroke.

Figure 5:
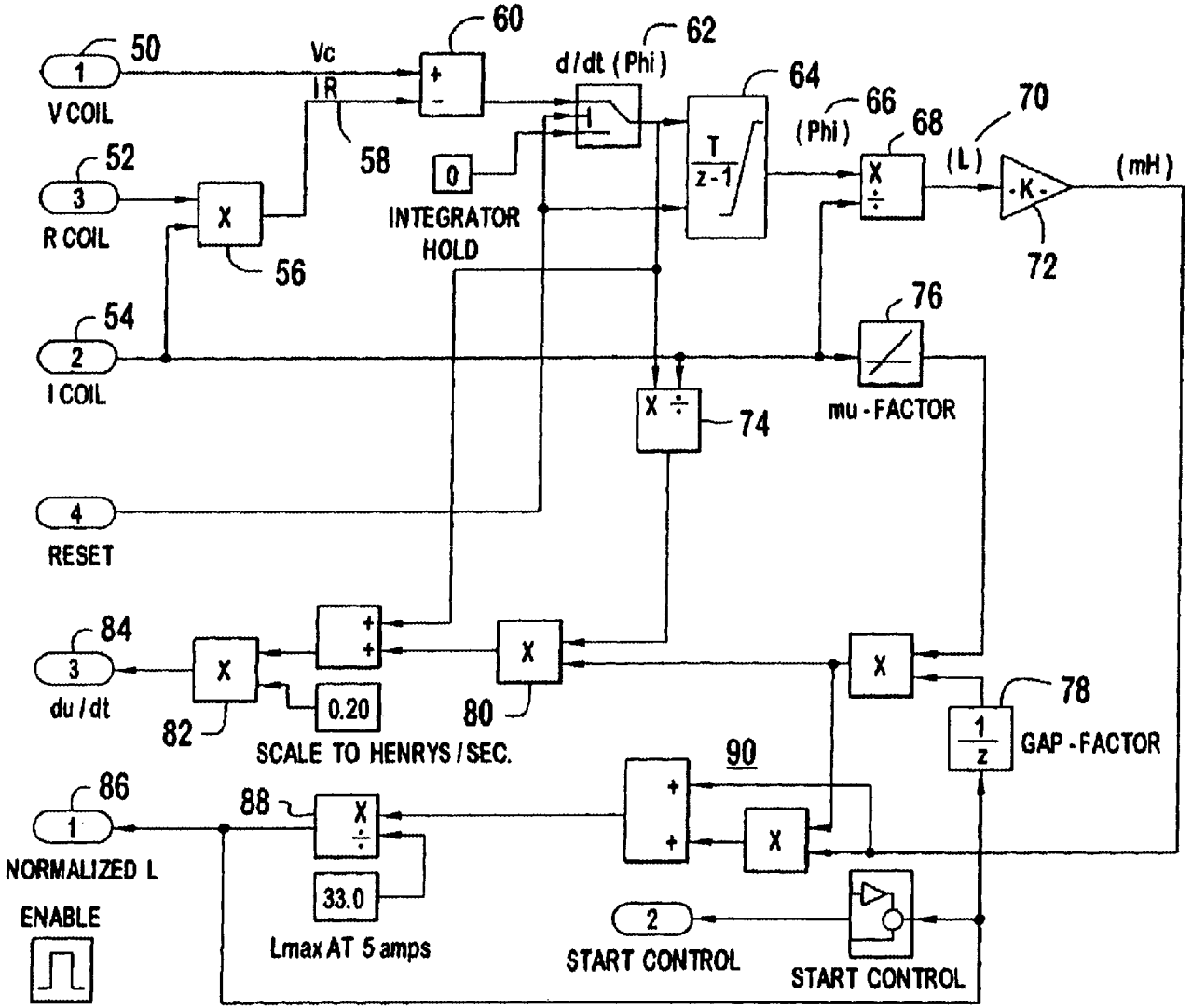
FIG. 5 is a schematic diagram illustrating a method of dynamically determining the inductance of an electromagnetic actuator as the armature moves from one pole piece to another, in accordance with a preferred embodiment of the present invention.
Figure 6:
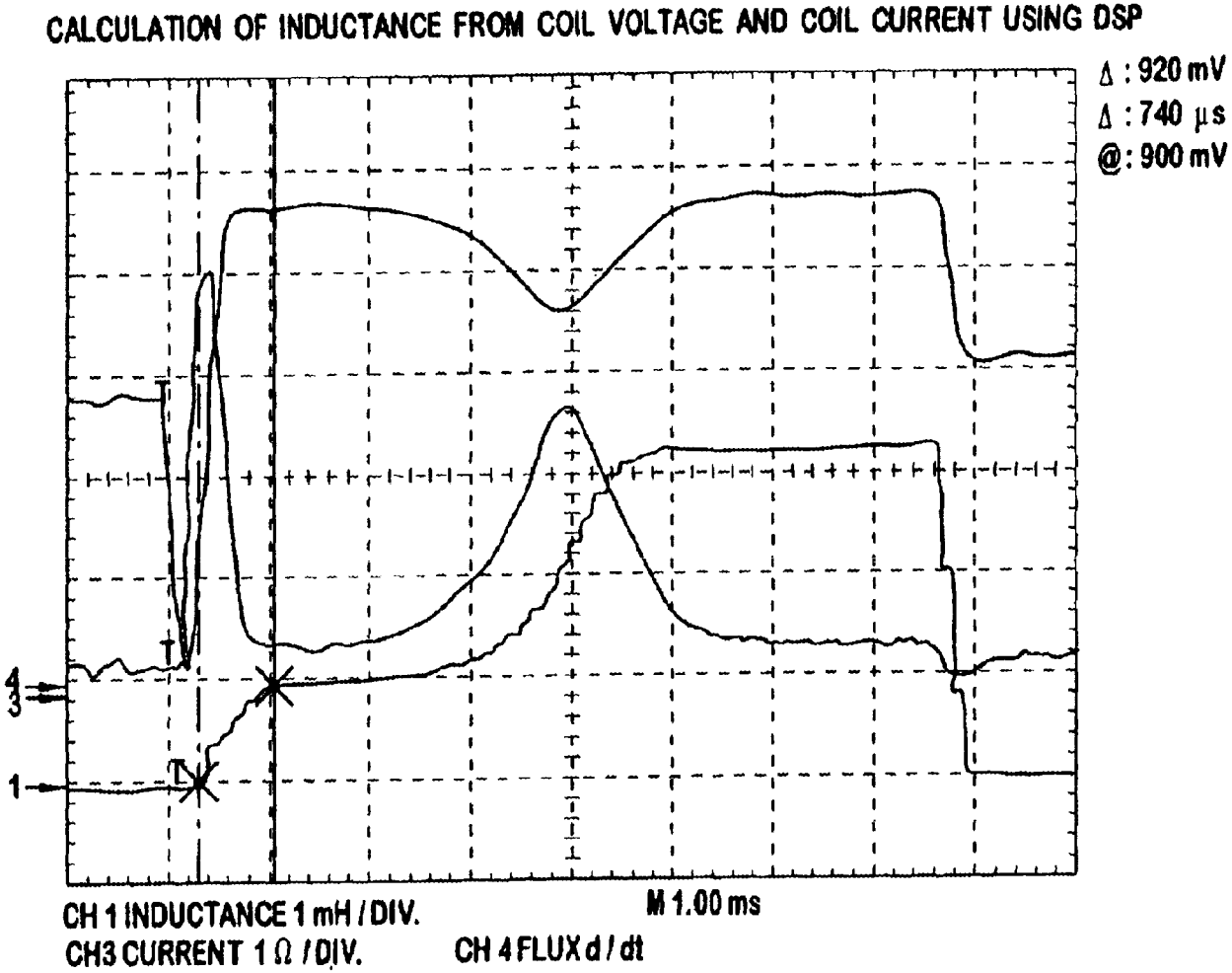
FIG. 6 illustrates the waveforms representing measured coil current and voltage, and calculated coil inductance using digital signal processing techniques in accordance with a preferred embodiment of the present invention.

Referring to FIGS. 3 and 5, the inductance of the actuator may be dynamically calculated as the armature moves from one pole piece to another by solving equations 1–3 above in iterative fashion during actuator operation. With reference to FIG. 5, the inductance of the actuator may be computed as follows. The coil resistance input 52 and coil voltage 50 are inputs to the system and may be determined by any convenient method, including direct measurement or by use of the flux mirror circuit method described above. As will be appreciated by those skilled in the art, the direct measurement method requires apparatus sufficient to detect a small differential voltage in the presence of a large common mode voltage, accordingly the flux mirror method is preferred. The coil current 54 is a readily measured input to the system because coil current 54 is under servo control via a controlled current source (not shown).

A microprocessor for computing inductance L in a dynamic fashion, as described above, must be capable of handling a complete cycle of processing and output the control signal in approximately 40 microseconds for an EVT actuator, assuming an armature flight time of approximately four milliseconds. FIG. 5 is a schematic representation of a method of computing the inductance of an actuator using a commercially available microprocessor. An exemplary suitable microprocessor in accordance with a preferred embodiment is a TMS320 C3x/4x Digital Signal Processor chip available from Texas Instruments. With currently available technology, the entire process could feasibly be implemented with many alternative DSP microprocessors, digital integrated circuits, or analog integrated circuits. In the case of soft landing a fuel injector armature, the flight time may be, for example, on the order of 200 microseconds. Accordingly, with fuel injectors, a high-speed analog controller is a preferred embodiment in order to achieve the necessary processing speed. In the case of fuel pressure regulators, a DSP processor may be used in a preferred embodiment.

Referring again to FIG. 5, and in accordance with equations 1–3 above, the resistance input 52 is multiplied 56 by the current input 54, yielding IR, as shown symbolically at 58. The calculated value of IR is subtracted 60 from the coil voltage input 50, yielding rate of change of magnetic flux, $d\Phi/dt$, as shown symbolically at 62. The flux, $\Phi$66, is computed by integrating the rate of change of flux $d\Phi/dt$ 62, as indicated at 64. Inductance L 70 of the actuator is computed by dividing the flux $\Phi$66 by the coil current input 54, as indicated at 68. The inductance L 70 is then scaled 72 to units of millihenrys (mH).

Air Gap and Permeability Compensation

As the armature moves within the solenoid, the inductance changes because the reluctance of the magnetic circuit is changing due to the changing permeability of the magnetic circuit. Reluctance in a magnetic circuit is analogous to resistance in an electric circuit. The components of reluctance are analogous to series resistors, a first being of low resistance and corresponding to the permeability of the ferromagnetic core (armature), and a second being of high resistance and corresponding to the permeability of air. As the armature moves toward the stator core, the total air gap constantly decreases, accordingly, its contribution to the analogous series circuit resistance constantly decreases. The net effect is that as the gap decreases, the total reluctance of the magnetic circuit constantly decreases. Therefore, the inductance constantly increases monotonically. For a given change in gap, the rate of change of inductance is greatest when the gap is the smallest. Accordingly, a system according to a presently preferred embodiment has the desirable characteristic that it is most sensitive to changes in armature position when the gap is the smallest, thus enabling the most refined control where it is needed the most, i.e., when the armature is close to striking the stator core.

The remainder of the inductance computation depicted schematically in FIG. 5 is designed to account for the non-linear way in which flux builds with respect to the current and the gap. The non-linear flux characteristic are functions of the air gap and the magnetic permeability of the materials used to fabricate the actuator. Because the magnetic permeability of the materials will vary depending on the particular alloys used, eat treat applied, and other related factors, in a preferred embodiment, two independent approximations may be applied to account for the air gap and variable permeability.

The first independent approximation is termed the "gap factor" approximation. The gap factor accounts for the non-linearity of the effect of the gap on magnetic flux. This approximation is necessary because the flux density is a function of gap size. The second independent approximation, accounting for the non-linearity of the B-H saturation characteristic, is termed the $\mu$ factor (or "mu" factor) approximation. The mu factor approximation accounts for the non-linear permeability of ferromagnetic materials.

"Mu" Factor Compensation

Figure 7:
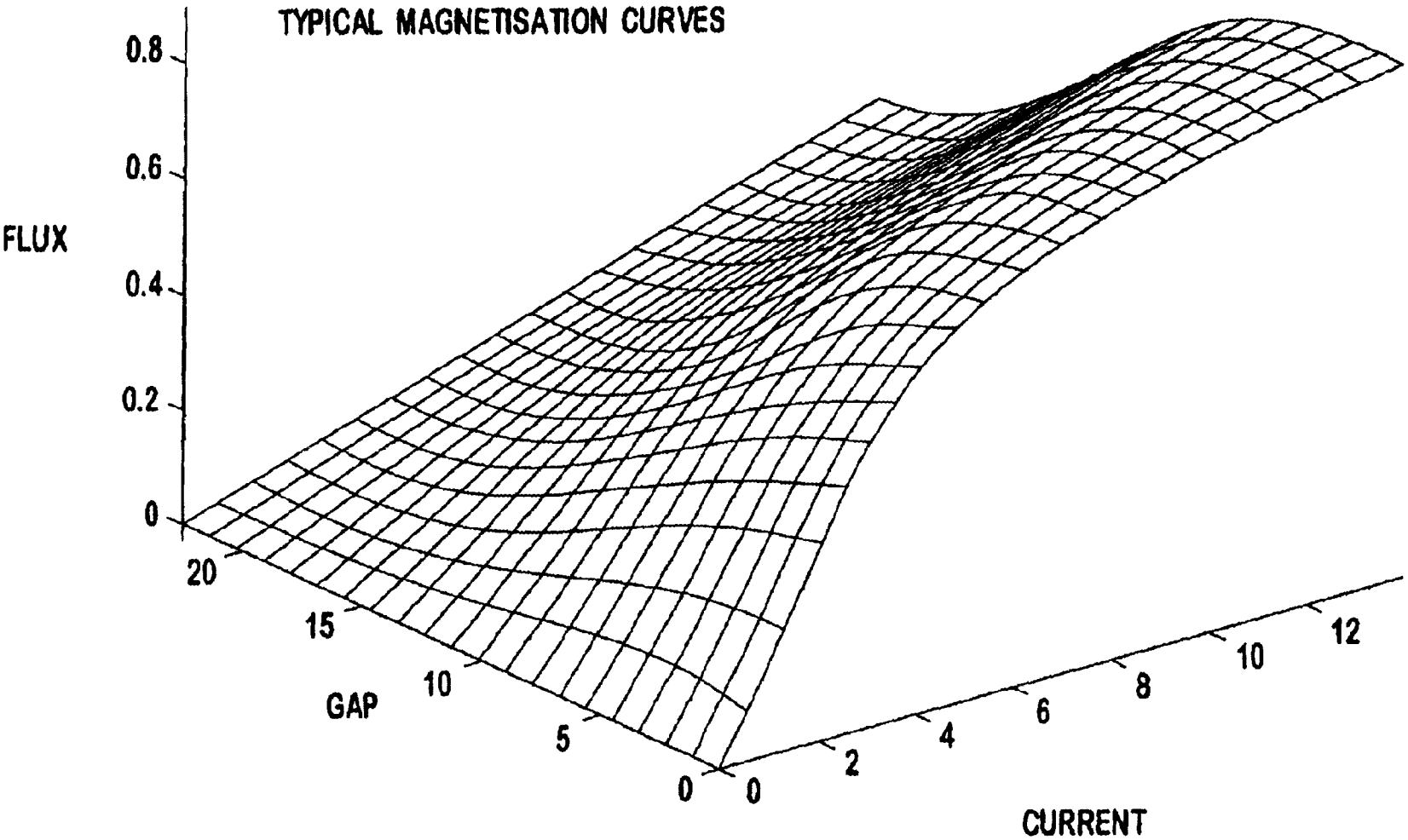
FIG. 7 illustrates typical B-H magnetization curves over a range of air gaps.

The magnetic flux density, B, is related to the magnetic field intensity, H, according to the equation $B=\mu H=\mu_r\mu_0 H$, where $\mu_0$ is the permeability of space ($\mu_0=4\times10^{-7}$ henrys/meter) and $\mu_r$ measures the effect of the magnetic dipole moments of the atoms comprising the material. The B-H characteristic is a function of the magnetic properties of the materials used to fabricate the actuator. A typical B-H characteristic for ferromagnetic materials is depicted in FIG. 7. The B-H characteristic demonstrates graphically that permeability of ferromagnetic materials varies in a non-linear fashion as magnetic field strength changes. Referring to FIG. 7, as magnetomotive force is applied to a magnetic circuit, the magnetic flux density increases in a non-linear fashion up to the point where the magnetic material reaches saturation and the curve begins to level off.

A table of mu factors for different air gaps can be constructed as follows. During the time the armature 24 is at rest against a pole piece 14, the current may be ramped up and down, taking care to avoid allowing the current to drop below the threshold required to maintain the armature 24 in contact with the pole piece 14. As the current changes, the coil voltage may be sampled and, together with the associated current level for each sampled voltage, used to compute a table of inductance values associated with each sampled voltage and current level. From the table of inductance values, a table of mu factors, characteristic of the B-H curve of the material used to fabricate the actuator, may be readily obtained. The above-described calibration process may be performed while the actuator is installed and operating in its intended environment. For example, in the case of an EVT actuator, the calibration may be performed while an engine is running while the actuator is in a "valve-open" position by varying the current and measuring the corresponding coil voltages, as described above.

The above described mu factor calibration may be performed on every actuator cycle, or less frequently, as desired. Once calibrated for a particular actuator, the mu factors will typically not change dramatically from minute-to-minute. However, the mu factors will tend to vary with temperature and the age of the actuator.

Gap Factor Compensation

The gap factor accounts for changes in the B-H characteristic as the armature moves within the actuator. As depicted in FIG. 7, the shape of the B-H curve depends on the air gap of the actuator. As the armature moves within the solenoid, the relative permeability of the system changes due to changes in the number of lines of magnetic flux coupled through the armature. The change in relative permeability in-turn changes the B-H characteristic of the system. The gap factor approximation accounts for the change in relative permeability. The gap factor is not measured directly; rather, the gap factor is successively approximated as being inversely proportional to the distance between the armature and the stator core.

The gap factor approximation is founded on the principle that when the gap is zero, the full effect of the B-H curve is felt by the armature because permeability of the solenoid core is maximum. Conversely, when the gap is very large, there is only air in the magnetic circuit and the average relative permeability of the solenoid core is at a minimum due to the large reluctance gap with a permeability of air. As shown in FIG. 7, when the air gap is large, the effect of the B-H curve on the armature is minimized. The variation of the B-H curve effect between zero-gap (all metal) and a very large gap (e.g., an air gap of several centimeters) may is approximated in a preferred embodiment as obeying an inverse relationship (i.e., a 1/x relationship).

The gap factor may be estimated during the armature stroke by a succession of approximations as follows. A first estimation of inductance L is made, assuming ideal gap factors. The estimated value of L may then be fed back to estimate the actual (non-ideal) gap factor necessary to produce the first estimated value of L. The process is repeated to successively refine the gap factor until the process converges to zero gap under the full effect of the B-H curve. This technique offers the benefit of progressively better position estimation as the armature 24 approaches the stator 14. Accordingly, maximum stator control may be achieved during the critical period when the armature/pole piece gap is on the order of tens of microns and the full effect of the B-H curve is realized.

Referring to FIG. 5, after scaling inductance, L 70, to units of milli-henrys 72, the inductance signal, L, may be compensated 90 by the mu 76 and gap 78 factors. After correcting for the gap factor and mu factors, inductance, L, is normalized, as depicted in 88 of FIG. 5, to vary preferably between near zero at a large gap to a maximum value of 1.0 at zero gap. The maximum inductance may be normalized to any number, 1.0 was chosen in this embodiment for convenience. The normalization of L accounts for variations in absolute inductance that may exist between different actuators of like design. Normalizing inductance also has the benefit of standardizing the range of input signals expected by the control system that receives the normalized inductance as an input. For example, the actual inductance of a particular actuator may range from 10 mH, at maximum gap to 35 mH at zero gap, while the actual inductance of a different actuator of like design may range from 12 mH at maximum gap to 40 mH at zero gap. Normalizing the inductance allows for automatic calibration between actuators of different absolute inductance and simplifies the control loop design for a standard range of inputs.

Velocity State Variable Estimation

As with the armature position estimation, which was derived by dynamically measuring inductance, as described above, the velocity state variable may be estimated by measuring rate of change of inductance. The "brute force" approach of differentiating the position signal to obtain the armature velocity does not generally achieve satisfactory results because minor "noisy" perturbations inherent in the position signal will have very large derivatives, and hence, will produce a corrupt velocity signal. Accordingly, armature velocity must be measured by an alternative method.

In accordance with a presently preferred embodiment, the armature velocity may be approximated by investigating the integral-derivative relationship between rate of change of magnetic flux, $d\Phi/dt$, and magnetic flux, $\Phi$, and recognizing that dL/dt is proportional to armature velocity as follows. As described above, position may be estimated by mapping inductance, L, to position, where L is, in-turn, determined by dividing flux, $\Phi$, by coil current, I, in accordance with the expression $\Phi=LI$. In like fashion, armature velocity may be directly estimated from the $d\Phi/dt$ signal, as calculated at 62 in FIG. 5. Because $d\Phi/dt$ is a relatively uncorrupted "clean signal" it may be used as a sufficiently precise estimate of armature velocity to enable a soft landing of the armature against the stator core.

The velocity approximation derivation is as follows: Given the basic relationship of $\Phi=LI$, $d\Phi/dt$ may be approximated as I dL/dt, where "I" is a real time measured value of the instantaneous current magnitude, therefore dI/dt does not have to be considered. Accordingly dL/dt is approximately equal to $(d\Phi/dt)/I$. In a preferred embodiment, dL/dt may be scaled by the same mu factor and gap factor used to scale L. The result of scaling dL/dt by the mu and gap factors is labeled "du/dt" in the present disclosure ("du/dt" is a "dummy variable" representing a rate term) and may be used to approximate armature velocity.

Referring again to FIG. 5, the above method may be implemented by dividing $d\Phi/dt$, the output of 62 ($d\Phi/dt$) by coil current, I, at 74. The resulting approximated value of dL/dt may then be compensated by the mu 76 and gap 78 factors, and scaled by a constant 82 to produce a rate term, du/dt 84, corresponding to armature velocity. Accordingly, the outputs of the system depicted in FIG. 5 are normalized inductance, L 86, (the position estimation term) and rate of change of inductance, du/dt, (the velocity estimation term).

Accordingly, in a presently preferred embodiment, the inductance L may be determined by measuring the magnetic flux. The rate of change of inductance may be estimated as being proportional to the rate of change of flux. The resulting state variables constitute the inputs to a control system for modulating coil current, and hence controlling armature velocity. A significant benefit of the above-described system for dynamically estimating the actuator state variables of position, velocity, and magnetic flux density is that there is no differentiation required to obtain rate information. For the reasons given above, it is highly desirable to avoid differentiation of non-ideal signals.

Another feature of the above-described approach is the ability to compensate inductance L for variations in the B-H characteristic due to changing permeability as the armature moves within the solenoid. Normalizing L and obtaining armature rate information from rate of change of flux, $d\Phi/dt$, also contributes to the simplicity of the actual implementation.

Figure 8:
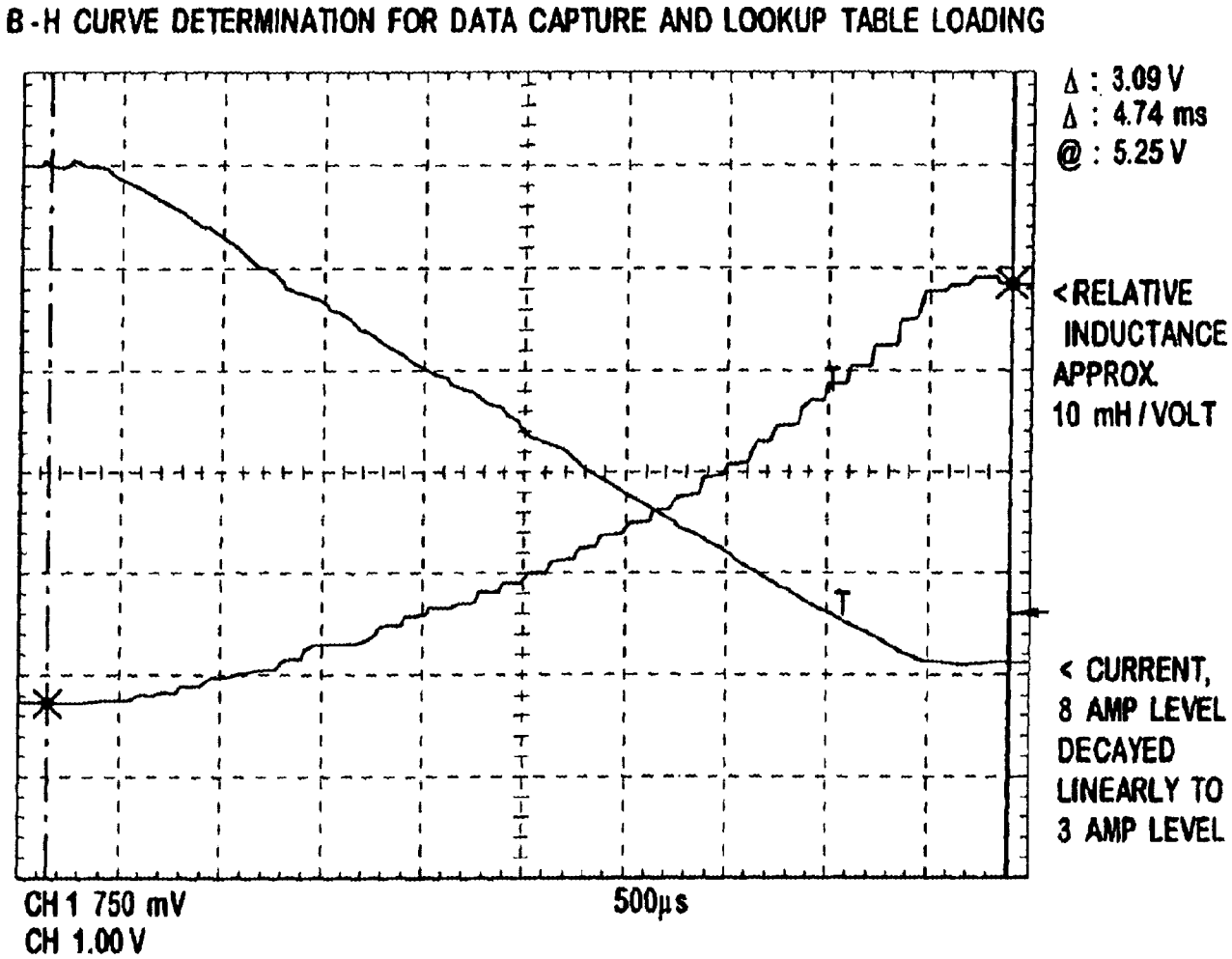
FIG. 8 illustrates mu factor autocalibration in accordance with the present invention.
Figure 9:
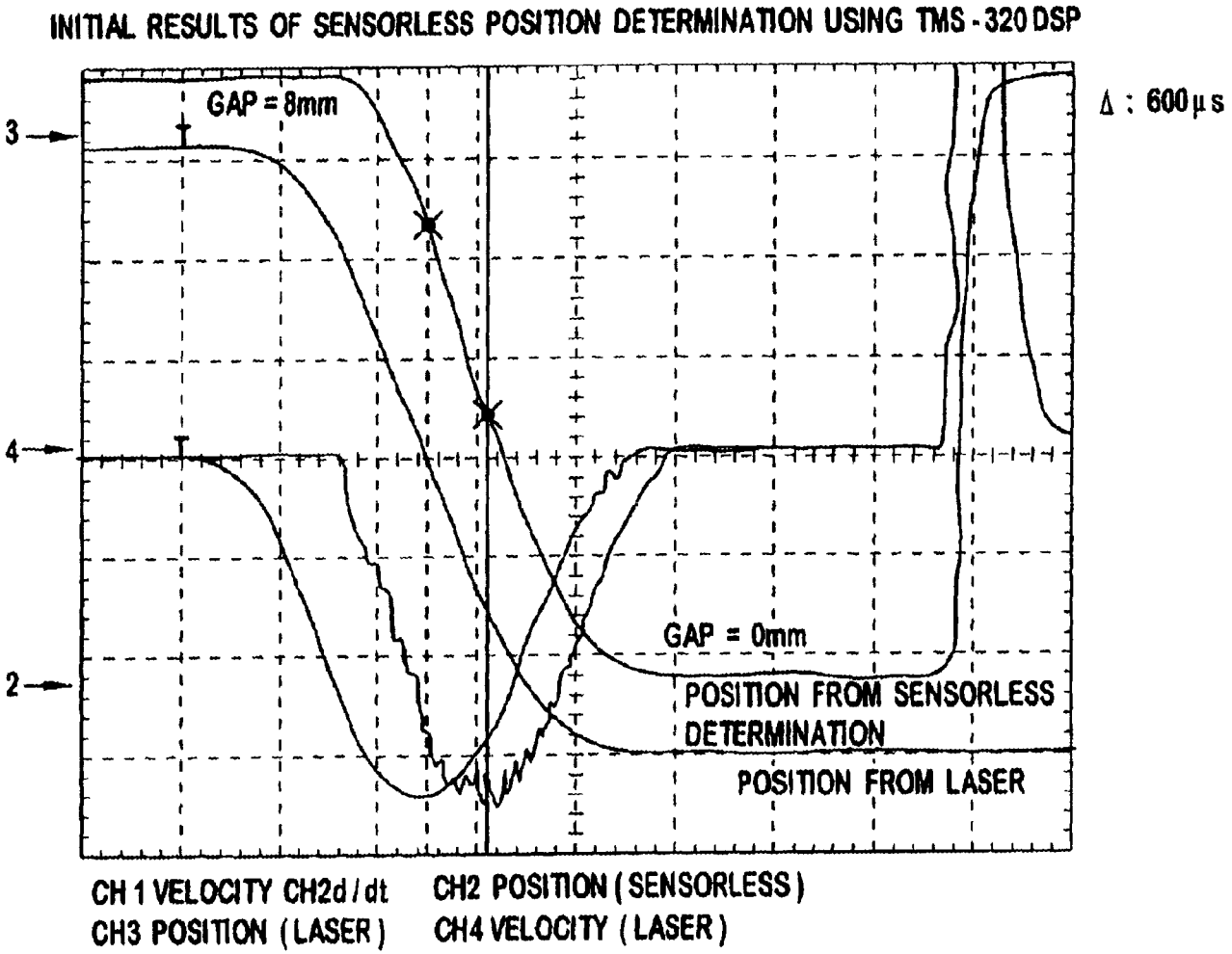
FIG. 9 illustrates the results of sensorless armature position estimation in accordance with the present invention.

The function of the mu factor can best be appreciated with reference to FIG. 8. FIG. 8 depicts typical data obtained during the autocalibration of the B-H curve and mu factor table loading. As the current is ramped up and down, the inductance changes in inverse proportion to the current through the coil. Accordingly, as the current decreases, the inductance increases.

Figure 10:
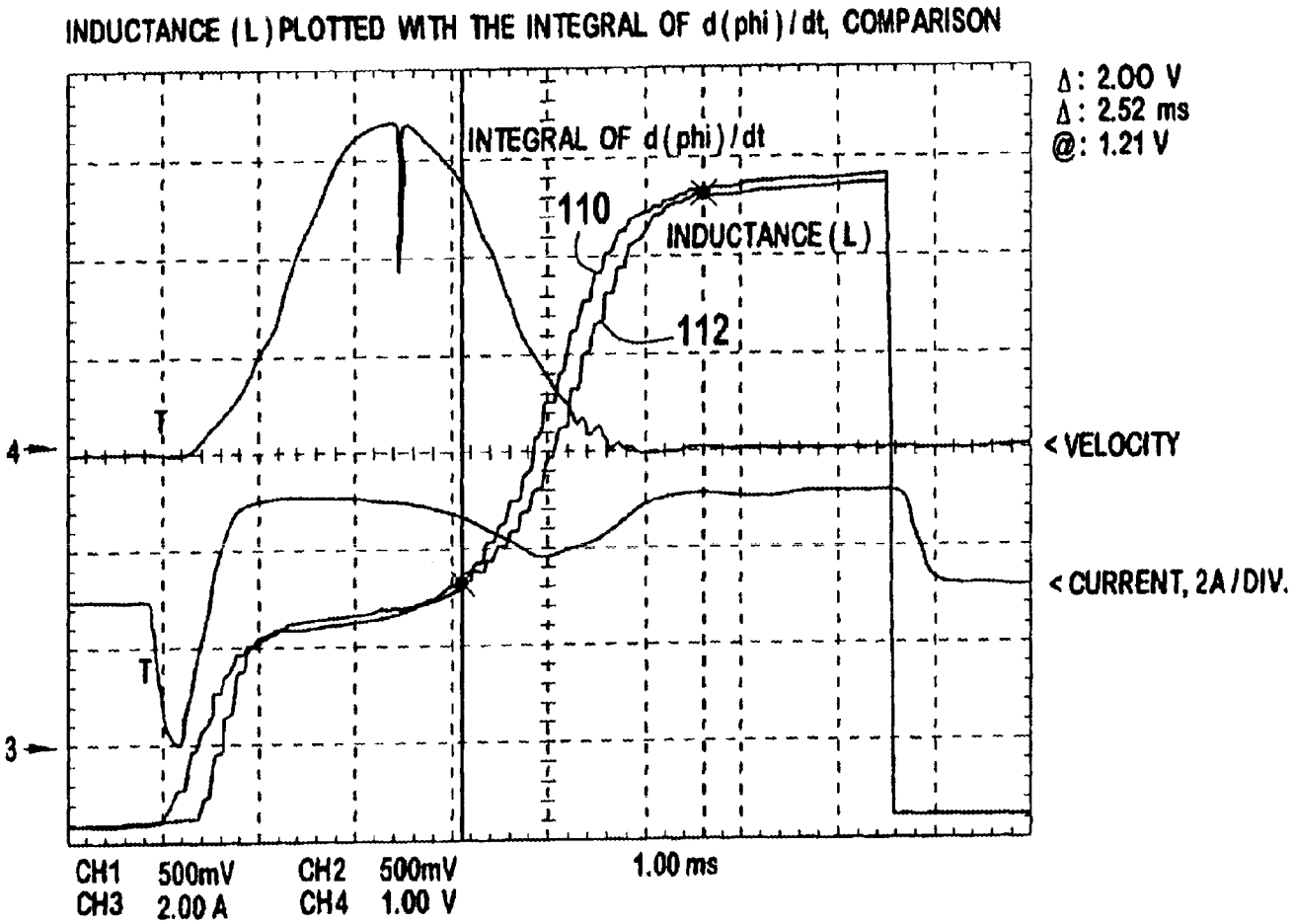
FIG. 10 illustrates a comparison of inductance with the integral of magnetic flux.

Waveform 110 in FIG. 10 is the integral rate signal (the dL/dt signal in a preferred embodiment) and waveform 112 is the estimated inductance L. Note that the shapes of the curves are very similar, thus validating empirically the simplifying assumptions that $d\Phi/dt$ may be approximated as I dL/dt, and dI/dt is negligible. These assumptions greatly reduce the complexity of the implementation hardware and/or software.

Estimation Of Closed Loop Controller Set Points (Running Set Points)

To this point we have set forth sensorless methods for obtaining the state variables of magnetic flux, armature position and armature velocity. It remains to be described how the state variables are used by a control system to control armature velocity and generate a soft landing against a stator core. The control system must receive as inputs armature position and velocity information to achieve a soft landing. In addition, as the armature approaches the stator core, greater precision and accuracy are required in the position and velocity estimates. Closed loop controller set points provide continuously updated target positions and velocities during the armature stroke.

Several basic principles governing control system design have become apparent during experimental testing. First, the control system should not start attempting to control armature velocity until the armature moves close enough to the stator core such that there is sufficient flux passing through the armature to exert significant control over the armature by changing the coil current. Stated another way, there must be sufficient magnetic energy in the working gap before the control system can exert control over the armature. As a rule of thumb, the armature should be close enough to the stator core that the amount of magnetic flux closed through the core is at least equal to the amount of flux that escapes the core. Attempting to exert control over the armature before sufficient magnetic flux has been closed through the core will result in ineffective control, large coil current and associated power dissipation in the form of heat.

The reluctance path of the actuator corresponds to the armature air gap. As explained above, reluctance is analogous to resistance in dc-resistive-circuit analysis and is defined as the ratio of the magnetomotive force to the total flux. When the air gap is large, the reluctance is great and a large portion of magnetic flux will leak away and not pass across the air gap where it is needed to control the force on the armature. Accordingly, it is ineffective to close the control loop on the system until the air gap is sufficiently small (i.e., the armature is close to the stator core) to keep flux from leaking away from the air gap.

When the armature is sufficiently close to the stator core for the system to exert control over the armature by varying the magnetic flux in the circuit, the control circuitry "closes the loop" and begins controlling the armature velocity. Once the armature is placed under closed loop control, running set points are determined corresponding to intermediate armature position and velocity targets during the armature stroke. The term "running set point" refers to a control system target for position or velocity that changes dynamically during the armature stroke. As the armature moves towards the stator core under closed-loop control, the set points for position and velocity are dynamically updated until the armature lands on the stator core (i.e., zero velocity). Running set points can be thought of as defining a near-optimal armature position and velocity trajectory sufficient to achieve a soft landing of the armature against the stator core.

Figure 11:
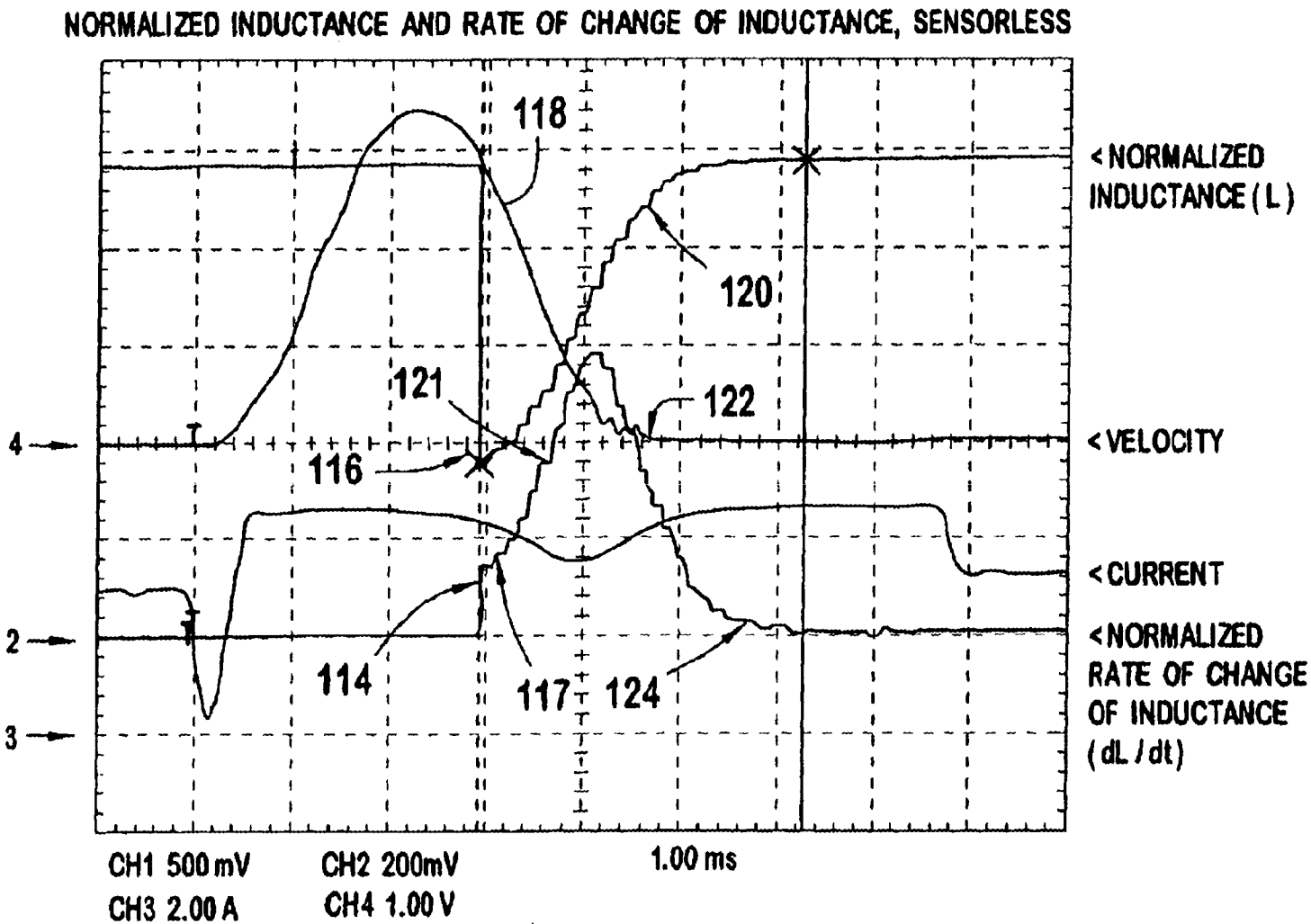
FIG. 11 illustrates normalized inductance and rate of change of inductance determined in a sensorless manner in accordance with the present invention.

FIG. 11 depicts the normalized inductance and rate of change of inductance that may be empirically determined as the optimal values for the running set points. The loop closed at 114 with initial set points 116 and 117. Under multivariate closed loop control, armature velocity 118 decreases as the set points are updated 120 and 121. As the armature continues to move, the system follows the updated set points 120 and 121 until the armature lands at near-zero velocity 122.

FIG. 11 also demonstrates that in an alternative preferred embodiment, the control loop logic may use inductance and rate of change of inductance directly as the state variables for controlling the system. In this embodiment, a reduction in hardware complexity is achieved because there is no need to mathematically convert inductance and rate of change of inductance into respective position and velocity terms for input to the control loop logic. Set point traces 120 and 121 in FIG. 11 demonstrate application of this method; rather than position and velocity, the traces represent the inductance and rate of change of inductance inputs to the control loop logic. After it was experimentally demonstrated that armature position and velocity could be accurately estimated from inductance and rate of change of inductance, it was further determined that armature velocity could be placed under multivariate control based directly on inductance and rate of change of inductance. Accordingly, the set points 120 and 121 of FIG. 11 are actually in units of inductance and rate of change of inductance, rather than position and velocity.

Figure 12:
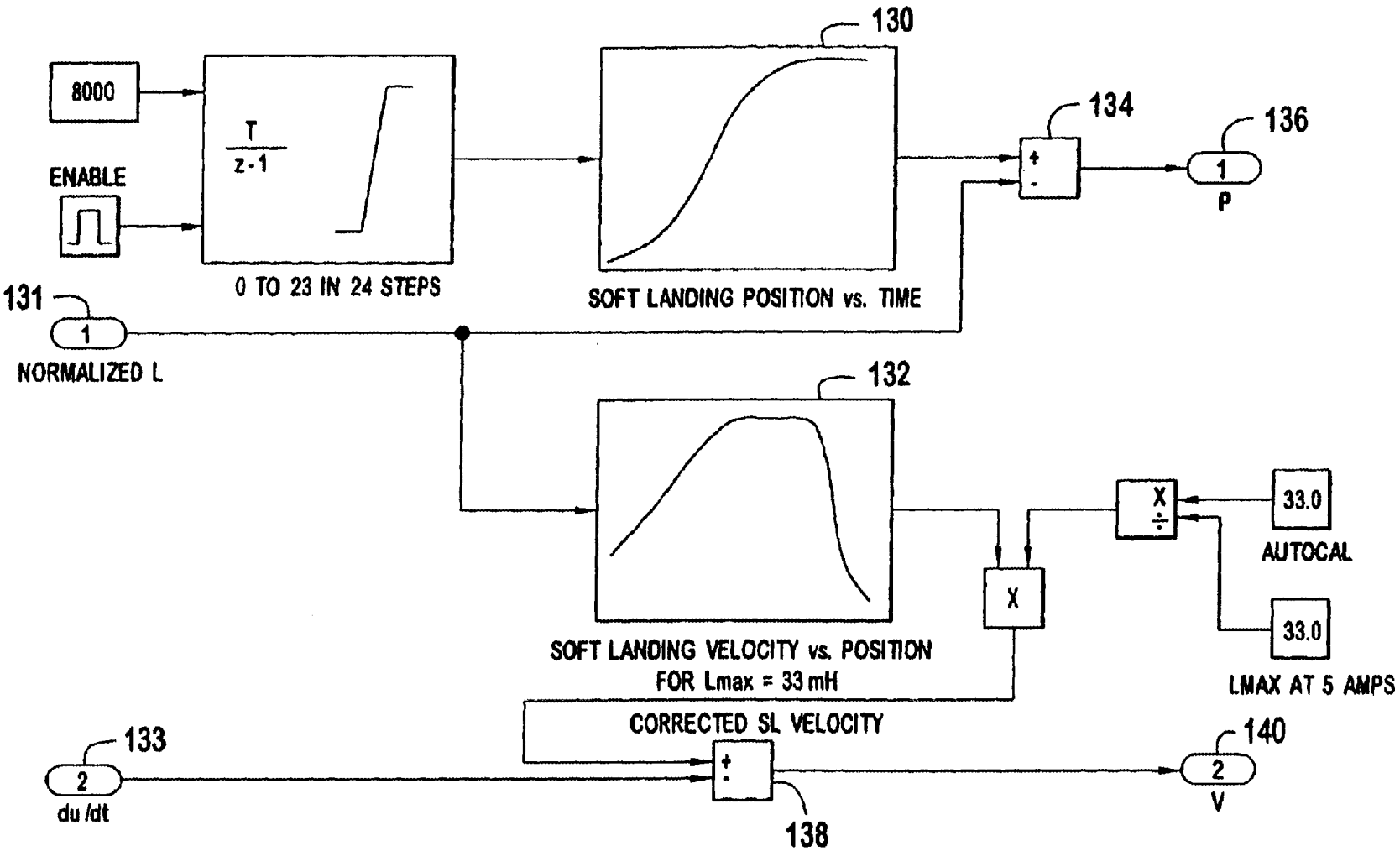
FIG. 12 is a block diagram of a lookup table implementation for determining running set points.

FIG. 12 is a block diagram demonstrating how running set points may be determined using normalized inductance and rate of change of inductance as inputs. The actual set point target values for inductance and rate of change of inductance are determined empirically and adjusted over the entire armature stroke to achieve an ideal soft landing of the armature against the stator core. The ideal set point values are stored in look-up tables, represented as 130 and 132. Note the "position" and "velocity" set point tables in FIG. 12, 130 and 132, respectively, may also correspond with inductance and rate of change of inductance in accordance with an alternative preferred embodiment described above. The set points may be empirically determined by adjusting an actuator for a perfect soft landing and recording the ideal trajectory of normalized inductance and rate of change of inductance.

The set points represent the ideal position and velocity (or, in a preferred embodiment, inductance and rate of change of inductance) of the armature at every point in the stroke. As depicted in FIG. 12, during operation, the actual normalized inductance 131 (or position in an alternative embodiment) is subtracted 134 from the appropriate set point corresponding to inductance (or position in an alternative embodiment), yielding a proportional error 136. In similar fashion, the rate of change of inductance 133 (or velocity in an alternative embodiment) is subtracted 138 from the appropriate set point corresponding to rate of change of inductance (or velocity in an alternative embodiment), yielding a corresponding rate error 140. The proportional error 136 and rate error 140 at multiple instants of time may then be applied as inputs to the control system logic.

Control System Logic

Figure 13:
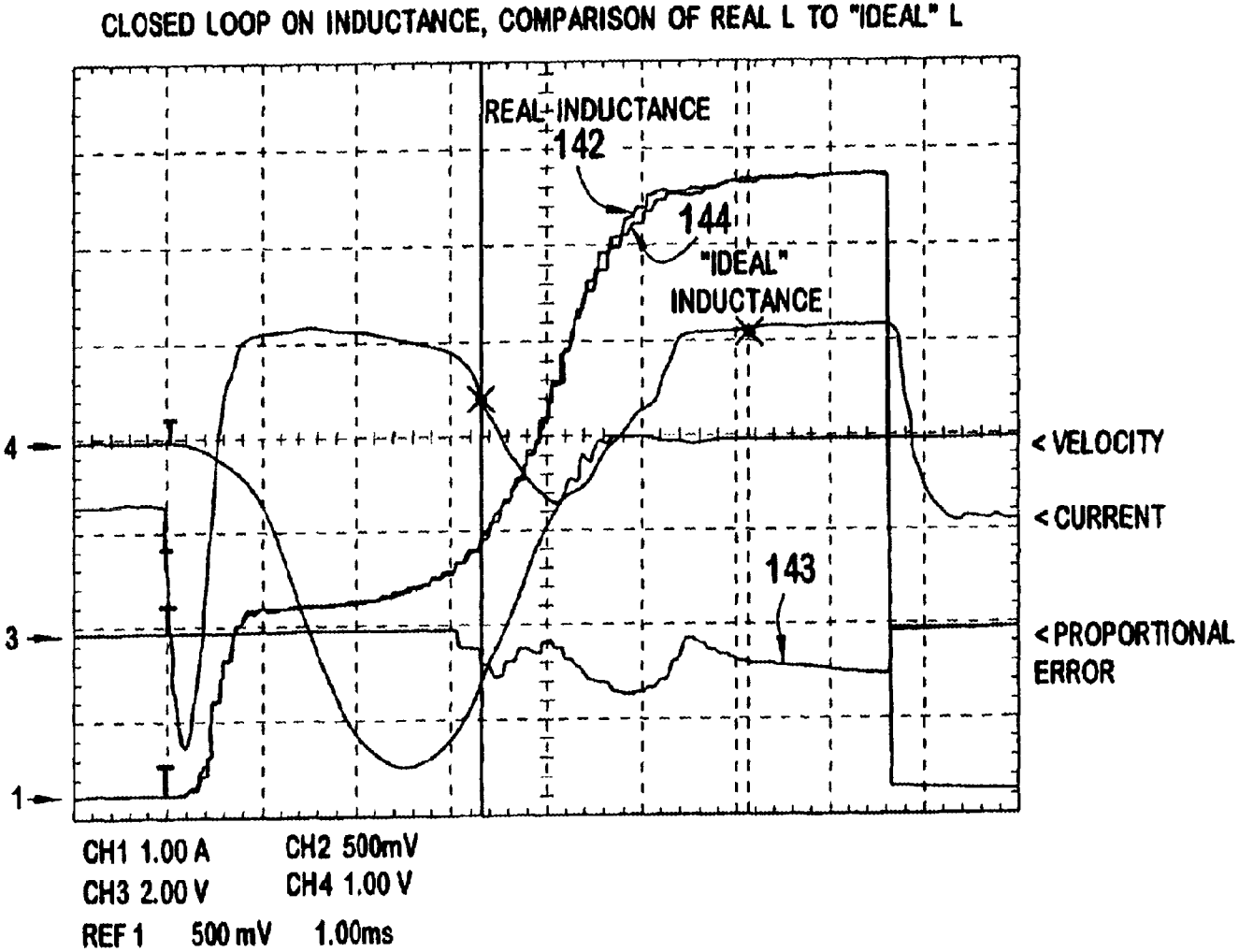
FIG. 13 illustrates a comparison of ideal inductance with measured inductance in accordance with the present invention.

FIG. 13 is a comparison of measured inductance 142 with ideal inductance 144 in accordance with a presently preferred embodiment. In this example, a conventional PID (proportional, integral, derivative) servo was used in this example to demonstrate the feasibility of tracking the ideal set point values of inductance. The control loop used the proportional error signal 143 as a feedback input. It may also be observed that under closed loop control, the PID controller varied the current based on the error signal to force the measured inductance signal 142 track with the ideal set points for inductance 144.

Figure 14:
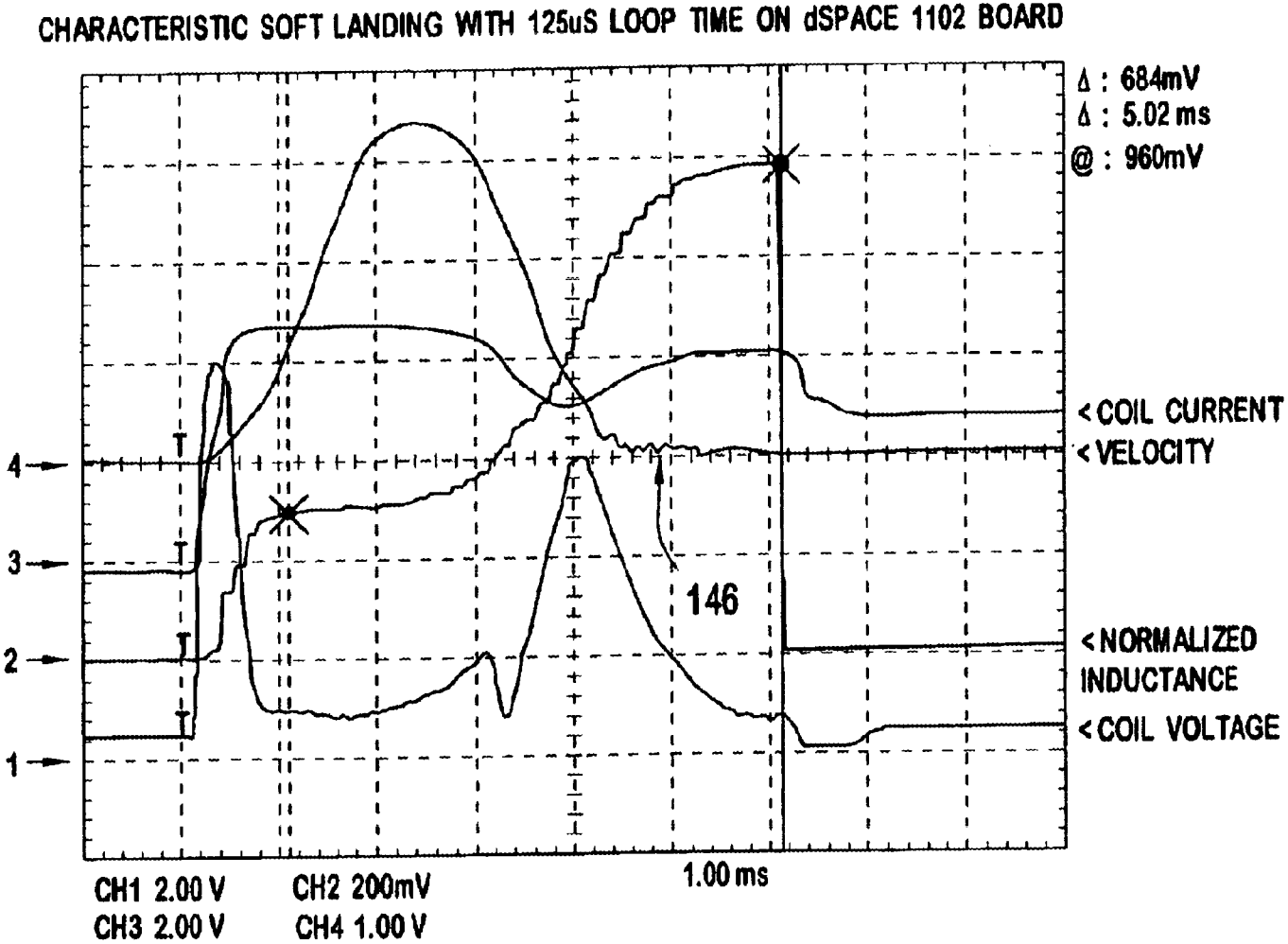
FIG. 14 illustrates a sensorless soft landing of an armature in an electromagnetic actuator in accordance with the present invention.

FIG. 15 demonstrates that a soft landing was achieved in accordance with the above-described methods, using the PID controller system described above in reference to FIG. 14. In this example, a dSPACE, Inc. 1102 commercial DSP microprocessor controller board, with a Texas Instruments TMS320 DSP was used. However, any conventional DSP or analog controller may be substituted. As shown in FIG. 15, the velocity of the armature in region 146, as the armature approaches the stator core, is sharply reduced, thus enabling a soft landing.

Any of several known multivariate control algorithms may be applied for closing the control loop based on the proportional error 136 and rate error 140. In a preferred embodiment, the control system is a fuzzy logic controller. In an alternative preferred embodiment, the control system is a state feedback system.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but have the full scope defined by the language of the following claims, and equivalents thereof.

What is claimed is:

1. A sensorless method of controlling the landing velocity of an armature in an electromagnetic actuator, comprising the steps of:

providing an electromagnetic actuator having a coil;

measuring the inductance of the coil in real-time as the armature moves within the coil;

compensating the measured inductance for non-linear permeability and magnetization effects; and providing the measured inductance to a control system for modulating a current delivered to the actuator.

2. The method of claim 1, further comprising the step of normalizing the measured inductance at zero gap.

3. The method of claim 2, further comprising the steps of:

estimating the rate of change of inductance of the coil in real-time as the armature moves within the actuator;

compensating the estimated rate of change of inductance for non-linear permeability and magnetization effects; and providing the compensated rate of change of inductance to a control system for modulating a current delivered to the actuator.

4. The method of claim 3, wherein the rate of change of inductance is determined without differentiating the inductance signal.

5. The method of claim 4, further comprising the step of capturing the B-H magnetization characteristics of the actuator during an armature stroke.

6. The method of claim 5, wherein the step of capturing the B-H magnetization characteristics of the actuator during an armature stroke further includes:

maintaining the armature in contact with a pole piece;

driving a time-varying current through the coil;

sampling the voltages associated with a plurality of current levels;

computing inductance values associated with each sampled voltage and current level; and computing mu factors for each inductance value.

7. The method of claim 5, wherein the inductance corresponds to an armature position estimation and the rate of change of inductance corresponds to an armature velocity estimation.

8. The method of claim 5, further comprising the step of measuring the coil resistance of the actuator while the armature is in a rest position against a stator core.

9. The method of claim 8, wherein the step of measuring the coil resistance of the actuator while the armature is in a rest position against a stator core further includes:

driving the coil with a steady-state current;

measuring the coil voltage necessary to maintain the steady-state current through the coil; and dividing the measured voltage by the steady-state current to calculate coil resistance.

10. The method of claim 9, wherein the control system is a fuzzy logic control system.

11. The method of claim 9, wherein the control system is a full state feedback control system.

12. The method of claim 9, wherein the control system is a PID control system.

13. The method of claim 9, wherein the electromechanical actuator is operatively attached to a fuel injector.

14. The method of claim 13, wherein the fuel injector is a direct injection fuel injector.

15. The method of claim 9, wherein the electromechanical actuator is an EVT actuator.

16. The method of claim 9, wherein the control system comprises a microprocessor.

17. The method of claim 9, wherein the control system comprises a digital logic circuit.

18. The method of claim 9, wherein the control system comprises an analog circuit.

19. A method of controlling the velocity of an armature in an electromagnetic actuator as the armature moves from a first position towards a second position, the electromagnetic actuator including a coil and a core at the second position, the coil conducting a current and generating a magnetic force to cause the armature to move towards and land at the second position, and a spring structure acting on the armature to bias the armature from the second position, the method comprising the steps of:

measuring the inductance of the coil as the armature moves within the actuator;

compensating the measured inductance for non-linear permeability and magnetization effects; and providing the measured inductance to a control system for modulating a current delivered to the actuator.

20. The method of controlling velocity of an armature in an electromagnetic actuator according to claim 19, further comprising the step of normalizing the measured inductance at zero gap.

21. The method of controlling velocity of an armature in an electromagnetic actuator according to claim 20, further comprising the steps of:

estimating the rate of change of inductance of the coil as the armature moves within the actuator;

compensating the estimated rate of change of inductance for non-linear permeability and magnetization effects; and providing the compensated rate of change of inductance to a control system for modulating a current delivered to the actuator.

22. The method of controlling velocity of an armature in an electromagnetic actuator according to claim 21, wherein the rate of change of inductance is determined without differentiating the inductance signal.

23. The method of controlling velocity of an armature in an electromagnetic actuator according to claim 22, further comprising the step of capturing the B-H magnetization characteristics of the actuator during an armature stroke.

24. The method of controlling velocity of an armature in an electromagnetic actuator according to claim 23, wherein the step of capturing the B-H magnetization characteristics of the actuator during an armature stroke further includes:

maintaining the armature in contact with a pole piece;

driving a time-varying current through the coil;

sampling the voltages associated with a plurality of current levels;

computing inductance values associated with each sampled voltage and current level; and computing mu factors for each inductance value.

25. The method of controlling velocity of an armature in an electromagnetic actuator according to claim 23, wherein the inductance corresponds to an armature position estimation and the rate of change of inductance corresponds to an armature velocity estimation.

26. The method of controlling velocity of an armature in an electromagnetic actuator according to claim 23, further comprising the step of measuring the coil resistance of the actuator while the armature is in a rest position against a stator core.

27. The method of controlling velocity of an armature in an electromagnetic actuator according to claim 26, wherein the step of measuring the coil resistance of the actuator while the armature is in a rest position against a stator core further includes:

driving the coil with a steady-state current;

measuring the coil voltage necessary to maintain the steady-state current through the coil; and dividing the measured voltage by the steady-state current to calculate coil resistance.

28. The method of claim 27, wherein the control system is a logic control system.

29. The method of claim 27, wherein the control system is a full state feedback control system.

30. The method of claim 27, wherein the control system is a PID) control system.

31. The method of claim 27, wherein the electromechanical actuator is operatively attached to a fuel injector.

32. The method of claim 31, wherein the fuel injector is a direct injection fuel injector.

33. The method of claim 27, wherein the electromechanical actuator is an EVT actuator.

34. The method of claim 27, wherein the control system comprises a microprocessor.

35. The method of claim 27, wherein the control system comprises a digital logic circuit.

36. The method of claim 27, wherein the control system comprises an analog circuit.

37. An apparatus for controlling velocity of an armature in an electromagnetic actuator as the armature moves from a first position towards a second position, the electromagnetic actuator including a coil and a core at the second position, the coil conducting a current and generating a magnetic force to cause the armature to move towards and land at the second position, and a spring structure acting on the armature to bias the armature from the second position, the apparatus comprising:

a means for estimating the rate of change of inductance of the coil as the armature moves within the actuator;

a means for compensating the estimated rate of change of inductance for non-linear permeability and magnetization effects;

a means for normalizing the measured inductance at zero gap;

a means for estimating the rate of change of inductance of the coil in real-time as the armature moves within the actuator;

a means for compensating the estimated rate of change of inductance for non-linear permeability and magnetization effects.

* * * * *